US006149771A

United States Patent [19]

Matuschczyk

[11] Patent Number: 6,149,771

[45] Date of Patent: Nov. 21, 2000

[54] METHOD FOR MANUFACTURING A PRESS JACKET AND A PRESS JACKET MADE IN ACCORDANCE WITH THIS METHOD

[75] Inventor: Uwe Matuschczyk, Geislingen, Germany

[73] Assignee: Voith Sulzer Papiermaschinen GmbH, Heidenheim, Germany

[21] Appl. No.: 09/085,022

[22] Filed: May 28, 1998

[30] Foreign Application Priority Data

Jun. 3, 1997 [DE] Germany ..... 197 23 211

[51] Int. Cl.[7] ..... D21F 3/02

[52] U.S. Cl. ..... 162/358.4; 156/209; 162/901; 428/163; 428/167; 428/169

[58] Field of Search ..... 162/358.4, 358.3, 162/901; 428/163, 167, 169, 171, 172; 198/847; 156/209

[56] References Cited

U.S. PATENT DOCUMENTS

| | | | |
|---|---|---|---|
| 4,229,254 | 10/1980 | Gill | 162/358.4 |
| 5,167,771 | 12/1992 | Sayers et al. | 162/358.4 |
| 5,208,087 | 5/1993 | Stigberg | 162/358.4 |
| 5,342,486 | 8/1994 | Jeffery et al. | 162/358.4 |
| 5,543,015 | 8/1996 | Jermo | 162/901 |
| 5,766,421 | 6/1998 | Aufrecht | 162/358.4 |

FOREIGN PATENT DOCUMENTS

| | | |
|---|---|---|
| 2161486 | 4/1996 | Canada . |
| 354743 | 2/1990 | European Pat. Off. . |
| 0541498 | 5/1993 | European Pat. Off. . |
| 9201143 | 5/1992 | Germany . |
| 4438354 | 5/1996 | Germany . |
| 4443598 | 6/1996 | Germany . |
| 29621524 | 4/1997 | Germany . |
| 8702080 | 4/1987 | WIPO . |
| 9202677 | 2/1992 | WIPO . |

*Primary Examiner*—Karen M. Hastings
*Attorney, Agent, or Firm*—Greenblum & Bernstein, P.L.C.

[57] ABSTRACT

Process for manufacturing a press jacket of flexible material for a press device and a press jacket that is adapted to drain a material web in a press opening in a paper making machine. The process includes arranging at least one reinforcing fiber in a jacket material that forms the press jacket so that the reinforcing fibers are arranged to run substantially in a peripheral direction of the press jacket, forming grooves to run substantially in the peripheral direction in at least one surface of the press jacket, and orienting the arrangment of the at least one reinforcing fiber and the formation of the grooves relative to each other so that the at least one reinforcing fiber and the grooves do not run radially superposed in a same direction.

39 Claims, 2 Drawing Sheets

METHOD FOR MANUFACTURING A PRESS JACKET AND A PRESS JACKET MADE IN ACCORDANCE WITH THIS METHOD

CROSS-REFERENCE TO RELATED APPLICATIONS

The present application claims priority under 35 U.S.C. § 119 of German Patent Application No. 197 23 211.6, filed on Jun. 3, 1997, the disclosure of which is expressly incorporated by reference herein in its entirety.

BACKGROUND OF THE INVENTION

1. Field of the Invention

The present invention relates to a process for manufacturing a press jacket of flexible material for a press device that drains a material web in a press opening, e.g., shoe presses for making paper. The press jacket includes grooves in at least one surface of the press jacket that run substantially in a peripheral direction, i.e., around the axis, and reinforcing fibers embedded in the jacket material that, at least a part of which, extends substantially in the peripheral direction of the press jacket. The present invention is also related to a press jacket made in accordance with this process.

2. Discussion of Background Information

Press jackets with peripheral grooves in the exterior of the press jacket are already known. The peripheral grooves serve to absorb water and to improve the drying characteristics of the press jacket in a drying press. However, in press jackets of this type, there is a danger that, because the jacket material is weakened in a region of the grooves, the peripheral grooves will increase tear formations in the press jacket. Use of these jackets is further complicated because rips that occur can proliferate and increase along the grooves.

Use or application of reinforcing fibers in the jacket material is known. The reinforcing fibers serve to increase the tensile strength of the press jacket, which is exposed to very high tensile forces. These high tensile forces can lead to a rupture of the press jacket, especially when utilized with shoe presses. Aside from reinforcing fibers running in a peripheral direction, reinforcing fibers can also be applied to run in the axial direction of the press jacket.

SUMMARY OF THE INVENTION

The present invention provides a method for manufacturing a press jacket of the type generally discussed above, and a press jacket made in accordance with this process. The press jacket distinguishes itself over the above-noted jackets by its great durability and stability. In particular, the danger of tear formation is reduced.

The present invention provides a distribution of grooves over a surface of a press jacket that is selected relative to a distribution of reinforcing fibers running (extending) in a peripheral direction. In this manner, the grooves and the reinforcing fibers are not positioned to run radially superposed, not even sectionally, in a same direction.

Via the method in accordance with the present invention, the danger of tear formation in the area of the peripheral grooves is significantly reduced. It has been determined that the danger of the tear formation is greatest where peripheral grooves run substantially in a same direction as the reinforcing fibers arranged within the jacket material. The reinforcing fibers, which work like a notch, constitute a weakening of the jacket material in a manner similar to the peripheral grooves, thus, increasing the danger of tear formation. This danger of forming tears is particularly disturbing because rips that occur tend to grow very quickly at the base of the groove and along the entire periphery of the press jacket. Thus, the danger of the press jacket rupturing is very high.

Via the method and the press jacket in accordance with the present invention, the coincidence of weak points of the press jacket, formed by the peripheral grooves and the reinforcing fibers, are substantially reduced, which correspondingly reduces the great danger of tear formation. By distributing the peripheral grooves and the reinforcing fibers in accordance with the present invention, the peripheral grooves and reinforcing fibers are arranged so as not to run radially superposed, not even sectionally, in a same direction, thus avoiding the appearance of especially weakened segments of the press jacket. Rather, the distribution of the peripheral grooves and the reinforcing fibers are selected in a targeted manner so that the distribution of grooves and fibers diverges from each other and no segments with the same course are present.

In accordance with an embodiment of the present invention, the grooves and the reinforcing fibers are provided in the press jacket with angles of inclination different from one another substantially in the peripheral direction. Via the different angles of inclination of the peripheral grooves and the reinforcing fibers, it is substantially guaranteed that that peripheral grooves and reinforcing fibers do not run radially superposed and thus in the same direction, not even sectionally, in the press jacket. In this manner, a double weakening of the press jacket material does not occur. Generally, peripheral grooves and reinforcing fibers may also be placed with equal inclination in the press jacket, if the placement of the peripheral grooves and reinforcing fibers are staggered axially with respect to each other. However, with different angles of inclination, the danger of tears forming is further reduced because the arrangement between the peripheral grooves and reinforcing fibers varies in the direction of the press jacket axis.

In a particular embodiment, the grooves may be arranged in the press jacket at a greater angle of inclination than the reinforcing fibers. In particular, the grooves may be arranged at an angle of inclination that is at least three times as great as the angle of inclination of the reinforcing fibers. This embodiment has proven to be especially advantageous for avoiding tear formation and for the durability of the press jacket.

In accordance with another embodiment of the invention, the grooves may be arranged in the press jacket at an angle of inclination that is opposite (i.e., the negative of) the angle of inclination of the reinforcing fibers. It is substantially guaranteed, via this embodiment, that the peripheral grooves and the reinforcing fibers do not run radially superposed, not even sectionally, and in a same direction in the press jacket. Thus, the formation of especially weakened areas of the press jacket does not occur.

In accordance with another embodiment of the present invention, the grooves are provided at an axial distance from each other in the press jacket that diverges from the axial distance with which the reinforcing fibers in the press jacket are arranged. Generally, the peripheral grooves and the reinforcing fibers may also be provided in the press jacket at a respectively equal axial distance from each other, if the peripheral grooves and the reinforcing fibers are arranged axially staggered from each other. Also, via different axial distances between the peripheral grooves and the reinforcing fibers, the danger of tear formation is further hindered with an arrangement between the peripheral grooves and the reinforcing fibers that varies along the axial length of the press jacket.

To ensure that feature of no superimposition of the grooves and fibers, the distances of the grooves and the reinforcing fibers are preferably selected so that they have no common integral multiples. In this manner, it is substantially guaranteed that the profile of the peripheral grooves and the profile of the reinforcing fibers do not coincide over the entire press jacket length.

In accordance with a further embodiment of the present invention, the grooves are provided at a greater distance from each other in the press jacket than the distance of the reinforcing fibers from each other. In particular, the grooves are provided at a distance from each other that is at least 1.15 times as great as the distance of the reinforcing fibers from one another. This particular embodiment has proven especially advantageous.

The peripheral grooves can be arranged as grooves closed in a ring shape in the press jacket. In accordance with another embodiment of the invention, the peripheral grooves can be provided in the press jacket in the form of a helical line running around a longitudinal axis of the press jacket .

Likewise, the reinforcing fibers can be arranged in the press jacket as reinforcing fibers closed in a ring shape and as a helical line running around the longitudinal axis of the press jacket. In accordance with another embodiment of the present invention, a single reinforcing fiber can be arranged in a helical line.

In accordance with another embodiment of the present invention, two or more reinforcing fibers can be arranged in the press jacket in a helical line. In particular, the reinforcing fibers may be arranged in the form of a multiple helical line.

In accordance with another embodiment of the present invention, a plurality of reinforcing fibers may be provided in the press jacket in layers that are radially superposed. In this manner, the tensile strength of the press jacket may be increased or, with constant tensile strength of the cross-section of the reinforcing fibers, reduced.

In accordance with another embodiment of the present invention, the distribution of the reinforcing fibers in the radially superposed layers of the press jacket are selected so that the reinforcing fibers do not run radially superposed, not even on a sectional basis, in the same direction. This embodiment substantially guarantees that the press jacket does not exhibit multiple weakened sections in which the danger of tear formations is particularly great.

In accordance with another embodiment of the present invention, reinforcing fibers running in the axial direction of the press jacket are arranged in the press jacket material along with the reinforcing fibers running in the peripheral direction. The overall stability of the press jacket may, therefore, be improved. In a particular embodiment, the axial fibers are positioned to run in a layer of the press jacket that is radially inward of a layer including the peripheral fibers. Generally, however, the peripheral fibers may be arranged radially inward of the axial fibers.

Press jackets manufactured in accordance with the process of the present invention, which may be developed further in the disclosed manner, may likewise exhibit the above-noted advantages.

The present invention is directed to a process for manufacturing a press jacket of flexible material for a press device, the press jacket adapted to drain a material web in a press opening in a paper making machine. The process includes arranging at least one reinforcing fiber in a jacket material that forms the press jacket so that the reinforcing fibers are arranged to run substantially in a peripheral direction of the press jacket, forming grooves to run substantially in the peripheral direction in at least one surface of the press jacket, and orienting the arrangment of the at least one reinforcing fiber and the formation of the grooves relative to each other so that the at least one reinforcing fiber and the grooves do not run radially superposed in a same direction.

In accordance with another feature of the present invention, the grooves are formed in the press jacket prior to the arrangement of the reinforcing fibers, and the process further includes positioning the grooves at an angle of inclination to a machine direction of the press jacket and positioning the at least one reinforcing fiber at an angle of inclination to the machine direction of the press jacket. Further, the grooves are positioned in the press jacket at an angle of inclination to the machine direction greater than the angle of inclination of the at least one reinforcement fiber to the machine direction. Still further, the grooves are positioned in the press jacket at an angle of inclination to the machine direction that is is at least approximately three times as great as the angle of inclination of the at least one reinforcing fiber to the machine direction. Further still, the grooves are positioned in the press jacket at an angle of inclination to the machine direction that is in a direction opposite the angle of inclination of the at least one reinforcing fiber to the machine direction.

In accordance with another feature of the present invention, the process further including spacing the grooves to be formed in the the press jacket at a groove axial distance and spacing the at least one reinforcing fiber to be arranged in the press jacket at a fiber axial distance. The groove axial distance is different than the fiber axial distance. Further, the process includes selecting the spacing of the groove axial distance before selecting the spacing of the fiber axial distance so that the groove axial distance and the fiber axial distance have no common integral multiple. Still further, the groove axial distance is greater than the fiber axial distance. In this regard, the groove axial distance is at least approximately 1.15 times as great as the fiber axial distance.

In accordance with still another feature of the present invention, the grooves are composed of ring-shaped, closed grooves.

In accordance with still another feature of the present invention, the process includes arranging the grooves in the press jacket to form a helical line running around a longitudinal axis of the press jacket.

In accordance with a further feature of the present invention, the at least one reinforcing fiber is composed of ring-shaped, closed reinforcing fibers.

In accordance with a still further feature of the present invention, the process includes positioning the at least one reinforcing fiber in at least one helical line running around a longitudinal axis of the press jacket within the press jacket material. Further, the at least one reinforcing fiber is composed of a helically oriented single reinforcing fiber. Alternatively, the at least one reinforcing fiber is composed of a plurality of helically oriented reinforcing fibers. The process further including arranging the plurality of helically oriented reinforcing fibers to form a multiple helical line.

In accordance with another feature of the present invention, the at least one reinforcing fiber is composed of a plurality of reinforcing fibers positioned in radially superposed layers. The process also includes arranging the plurality of reinforcing fibers in radially superposed layers so that the reinforcing fibers in different layers are not radially superposed in the same direction in the press jacket.

In accordance with still another feature of the present invention, inserting reinforcing fibers that extend substantially in the axial direction of the press jacket. Further, positioning the substantially axially extending reinforcing fibers radially inside of the peripherally running at least one reinforcing fibers. Alternatively, positioning the substantially axially extending reinforcing fibers radially outside of the peripherally running at least one reinforcing fiber.

The present invention is also directed to a press jacket of flexible material for a press device adapted to drain a material web in a press opening. The press jacket includes grooves running substantially in a peripheral direction in at least one surface of the press jacket, and at least one reinforcing fiber embedded in the flexible material that substantially extend in a peripheral direction of the press jacket. The grooves and the at least one reinforcing fiber are oriented relative to each other so that the grooves and the at least one reinforcing fiber do not run radially superposed over each other in a same direction.

In accordance with another feature of the present invention, the press jacket is adapted to rotate in a rotation direction. Further, the grooves are formed at a groove angle to the rotation direction, the at least one reinforcing fiber is arranged at a fiber angle to the rotation direction, and the groove angle and fiber angle are different angles. Further still, the groove angle is greater than the fiber angle, e.g., the groove angle is at least approximately three times as great as the fiber angle. Still further, the groove angle is oriented in a direction opposite the fiber angle.

In accordance with another feature of the present invention, the grooves are positioned at an axial groove distance from each other, the at least one reinforcing fiber are positioned at an axial fiber distance from each other, and the axial groove distance is different from the axial fiber distance. Further, the axial groove distance and the axial fiber distance do not exhibit a common integral multiple. Still further, the axial groove distance is greater than the axial fiber distance, e.g., the groove distance is at least approximately 1.15 times as great as the axial fiber distance.

In accordance with still another feature of the present invention, the grooves are formed in a ring-shaped manner around a periphery of the press jacket.

In accordance with still another feature of the present invention, the grooves are formed by a helical line running around a longitudinal axis of the press jacket.

In accordance with a further feature of the present invention, the at least one reinforcing fiber being closed in a ring shape.

In accordance with another feature of the present invention, the at least one reinforcing fiber is formed by a helical line around a longitudinal axis of the press jacket. Further, the at least one reinforcing fiber is composed of a single helical reinforcing fiber. Alternatively, the at least one reinforcing fiber is composed of a plurality of helical reinforcing fibers. Further, the plurality of reinforcing fibers form a multiple helical line.

In accordance with still another feature of the present invention, the at least one reinforcing fiber includes a plurality of reinforcing fibers located in radially superposed layers. Further, the plurality of reinforcing fibers are arranged so that the reinforcing fibers in different layers are not radially superposed in the same direction in the press jacket.

In accordance with yet another feature of the present invention, the press jacket further including substantially axially extending reinforcing fibers located within the press jacket. The substantially axially extending reinforcing fibers are located either radially inside of the reinforcing fibers running in the peripheral direction, or radially outside of the reinforcing fibers running in the peripheral direction.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 3:
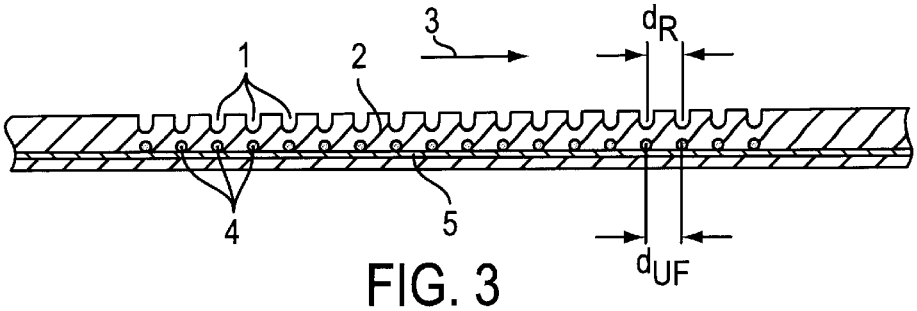
FIG. 3 (PRIOR ART)
FIG. 3 illustrates a section of a press jacket in accordance with the prior art.

As illustrated in FIG. 3, conventional press jackets include a number of peripheral grooves 1 distributed or arranged over a surface of a press jacket 2. In particular, a number of peripheral grooves 1 follow each other in an axial direction 3 of press jacket 2. Peripheral grooves 1 can be provided as ring-shaped, continuous grooves or as helical grooves winding around the longitudinal axis of press jacket 2.

Reinforcing fibers 4 and 5 are arranged in the press jacket material forming press jacket 2 radially inside of peripheral grooves 1. Reinforcing fibers 5 are arranged to run in axial direction 3 and reinforcing fibers 4 are arranged to generally run in a peripheral (around the axis) direction of press jacket 2. As shown in the illustration, reinforcing fibers 4 running in the peripheral direction are arranged to lie radially below peripheral grooves 1. As a result of this arrangement, doubly weakened sections of press jacket 2 arise between peripheral grooves 1 and reinforcing fibers 4. These doubly weakened section lead to a particularly great danger of tear formation in these particular sections. This problem is increased because the tears that arise can grow along a foundation of grooves 1 over the entire periphery of press jacket 2 and cause press jacket 2 to burst open.

Figure 1A:
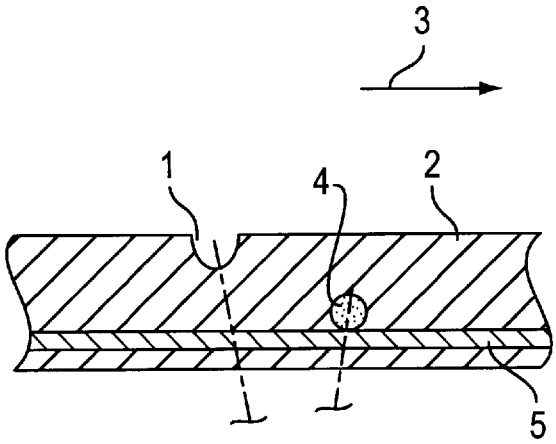
FIGS. 1 and 1*b* illustrates a cross-section through a portion of a first variation of the press jacket in accordance with the present invention.
Figure 1B:
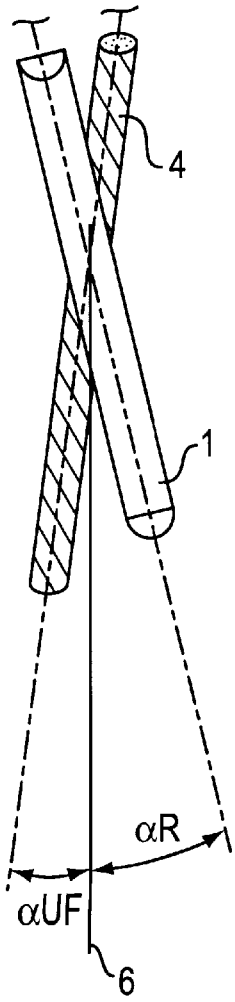

In a first embodiment of the present invention, a press jacket 2, depicted in FIG. 1, illustrates that reinforcing fibers 4 running in a peripheral direction are not arranged to lie radially below peripheral grooves 1. A machine direction or direction of rotation 6 of press jacket 2 is shown in which peripheral grooves 1 and reinforcing fibers 4 are positioned to run in opposite directions and at angles to machine direction 6. In particular, peripheral grooves 1 form an angle $\alpha_R$ with respect to machine direction 6 and reinforcing fibers 4 form an angle $\alpha_{UF}$ with respect to machine direction 6, and angle $\alpha_R$ extends in a direction opposite angle $\alpha_{UF}$ with respect to machine direction 6. In the exemplary embodiment depicted in FIG. 1, the magnitude of angle $\alpha_R$ is greater than the magnitude of angle $\alpha_{UF}$. Thus, peripheral grooves 1 run at a greater angle of inclination to machine direction 6 than reinforcing fibers 4. The opposite signs of the respective angles of inclination $\alpha_R$ and $\alpha_{UF}$ ensures that press jacket 2 will include no cross-sectional planes in which peripheral grooves 1 and reinforcing fibers 4 run radially superposed in a same orientation, even on a sectional basis. In this manner, a double weakening of press jacket 2 is substantially avoided.

Figure 2A:
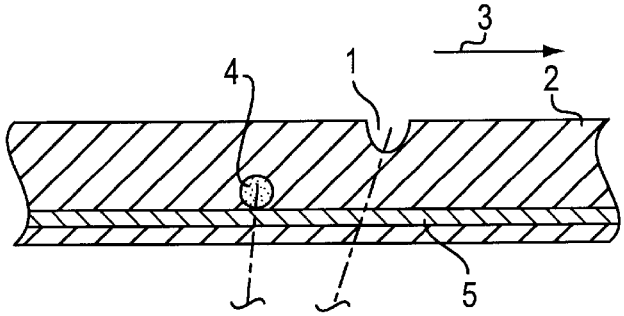
FIGS. 2 and 2*b* illustrates a variation of the press jacket depicted in FIG. 1 in accordance with the present invention.
Figure 2B:
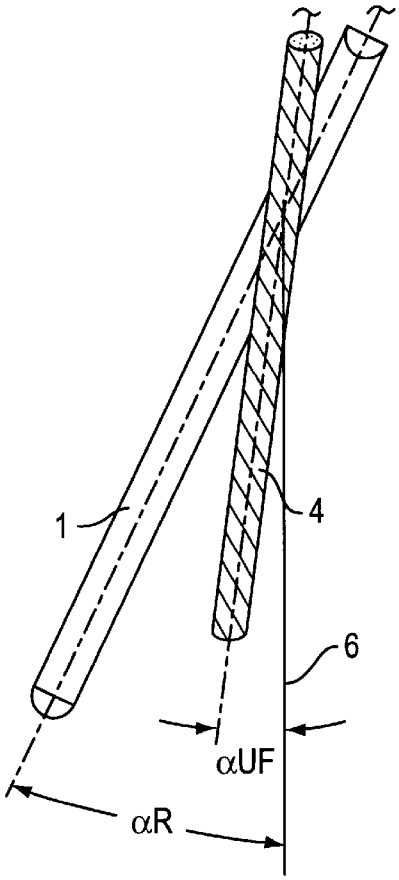

In another embodiment of the present invention, FIG. 2 illustrates press jacket 2 in which peripheral grooves 1 and reinforcing fibers 4 extend at a same direction of inclination with respect to machine direction 6, however, the magnitude of the respective angles of inclination $\alpha_R$ and of $\alpha_{UF}$, are different. Angle of inclination $\alpha_R$ of peripheral grooves 1 is greater, e.g., at least three times as great as angle of inclination $\alpha_{UF}$ of reinforcing fibers 4. In this manner, it can bc ensured that press jacket 2 will include no cross-sectional planes in which peripheral grooves 1 and reinforcing fibers 4 run in the same direction, even on a sectional basis. Thus, this alternative embodiment likewise substantially avoids doubly weakened sections of press jacket 2, In addition to a crossed progression of peripheral grooves 1 and reinforcing fibers 4, these elements may be distributed axially in a staggered manner over the periphery of press jacket 2 so that there are no cross-sectional planes of press jacket 2 which peripheral grooves 1 and reinforcing fibers 4 run in the same direction, even on a sectional basis. Rather, either only peripheral grooves 1 or only reinforcing fibers 4 are present in the cross-sectional plane.

In accordance with the above-noted features of the present invention, a press jacket having a particularly low danger of tear formation is provided while also exhibiting high tensile strength and good water absorption capacity. The stability of press jacket may be additionally strengthened by utilizing axial fibers 5 as shown in the accompanying figures.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

| Reference List | |
|---|---|
| 1. | Peripheral groove |
| 2. | Press jacket |
| 3. | Axial direction |
| 4. | Reinforcing fibers |
| 5. | Reinforcing fibers |
| 6. | Machine or rotational direction |
| $\alpha_R$ | Angle of inclination of peripheral groove |
| $\alpha_{UF}$ | Angle of inclination of reinforcing fibers |
| $d_R$ | Distance between peripheral grooves |
| $d_{UF}$ | Distance between reinforcing fibers |

What is claimed is:

1. A process for manufacturing a press jacket of flexible material for a press device, the press jacket adapted to drain a material web in a press opening in a paper making machine, the process comprising:

arranging at least one reinforcing fiber in a jacket material that forms the press jacket, the reinforcing fibers arranged to run substantially in a peripheral direction of the press jacket;

forming grooves to run substantially in the peripheral direction in at least one surface of the press jacket; and orienting the arrangement of the at least one reinforcing fiber and the formation of the grooves relative to each other so that the at least one reinforcing fiber and the grooves do not run radially superposed in a same direction, wherein the grooves are formed in the press jacket prior to the arrangement of the reinforcing fibers;

positioning the grooves at an angle of inclination to a machine direction of the press jacket; and positioning the at least one reinforcing fiber at an angle of inclination to the machine direction of the press jacket, wherein the grooves are positioned in the press jacket at an angle of inclination to the machine direction greater than the angle of inclination of the at least one reinforcement fiber to the machine direction.

2. The process in accordance with claim 1, wherein the grooves are positioned in the press jacket at an angle of inclination to the machine direction that is is at least approximately three times as great as the angle of inclination of the at least one reinforcing fiber to the machine direction.

3. The process in accordance with claim 1, further comprising:

spacing the grooves to be formed in the press jacket at a groove axial distance;

spacing the at least one reinforcing fiber to be arranged in the press jacket at a fiber axial distance; and the groove axial distance being different than the fiber axial distance.

4. The process in accordance with claim 3, further comprising selecting the spacing of the groove axial distance before selecting the spacing of the fiber axial distance so that the groove axial distance and the fiber axial distance have no common integral multiple.

5. The process in accordance with claim 3, wherein the groove axial distance is greater than the fiber axial distance.

6. The process in accordance with claim 5, wherein the groove axial distance is at least approximately 1.15 times as great as the fiber axial distance.

7. The process in accordance with claim 1, wherein the grooves are composed of ring-shaped, closed grooves.

8. The process in accordance with claim 1, further comprising arranging the grooves in the press jacket to form a helical line running around a longitudinal axis of the press jacket.

9. The process in accordance with claim 1, wherein the at least one reinforcing fiber is composed of ring-shaped, closed reinforcing fibers.

10. The process in accordance with claim 1, further comprising positioning the at least one reinforcing fiber in at least one helical line that runs around a longitudinal axis of the press jacket within the press jacket material.

11. The process in accordance with claim 10, wherein the at least one reinforcing fiber is composed of a helically oriented single reinforcing fiber.

12. The process in accordance with claim 10, wherein the at least one reinforcing fiber is composed of a plurality of helically oriented reinforcing fibers.

13. The process in accordance with claim 12, further comprising arranging the plurality of helically oriented reinforcing fibers to form a multiple helical line.

14. The process in accordance with claim 1, further comprising positioning a plurality of reinforcing fibers in radially superposed layers.

15. The process in accordance with claim 14, further comprising:

arranging the plurality of reinforcing fibers in radially superposed layers so that the reinforcing fibers in different layers are not radially superposed in the same direction in the press jacket.

16. The process in accordance with claim 1, further comprising:

inserting reinforcing fibers that extend substantially in the axial direction of the press jacket.

17. The process in accordance with claim 16, further comprising:

positioning the substantially axially extending reinforcing fibers radially inside of the peripherally running at least one reinforcing fibers.

18. The process in accordance with claim 16, further comprising:

positioning the substantially axially extending reinforcing fibers radially outside of the peripherally running at least one reinforcing fiber.

19. A process for manufacturing a press jacket of flexible material for a press device, the press jacket adapted to drain a material web in a press opening in a paper making machine, the process comprising:

arranging at least one reinforcing fiber in a jacket material that forms the press jacket, the reinforcing fibers arranged to run substantially in a peripheral direction of the press jacket;

forming grooves to run substantially in the peripheral direction in at least one surface of the press jacket;

orienting the arrangement of the at least one reinforcing fiber and the formation of the grooves relative to each other so that the at least one reinforcing fiber and the grooves do not run radially superposed in a same direction, wherein the grooves are formed in the press jacket prior to the arrangement of the reinforcing fibers;

positioning the grooves at an angle of inclination to a machine direction of the press jacket; and positioning the at least one reinforcing fiber at an angle of inclination to the machine direction of the press jacket, wherein the grooves are positioned in the press jacket at an angle of inclination to the machine direction that is in a direction opposite the angle of inclination of the at least one reinforcing fiber to the machine direction.

20. A press jacket of flexible material for a press device adapted to drain a material web in a press opening, comprising:

grooves running substantially in a peripheral direction in at least one surface of the press jacket;

at least one reinforcing fiber embedded in the flexible material that substantially extends in a peripheral direction of the press jacket; and the grooves and the at least one reinforcing fiber being oriented relative to each other so that the grooves and the at least one reinforcing fiber do not run radially superposed over each other in a same direction, wherein the press jacket is adapted to rotate in a rotation direction;

the grooves being formed at a groove angle to the rotation direction;

the at least one reinforcing fiber being arranged at a fiber angle to the rotation direction; and the groove angle and fiber angle being different angles.

21. The press jacket in accordance with claim 20, the groove angle being greater than the fiber angle.

22. The press jacket in accordance with claim 21, the groove angle being at least approximately three times as great as the fiber angle.

23. The press jacket in accordance with claim 20, the groove angle being oriented in a direction opposite the fiber angle.

24. The press jacket in accordance with claim 20, the grooves are positioned at an axial groove distance from each other;

the at least one reinforcing fiber ar e positioned at an axial fiber distance from each other; and the axial groove distance is different from the axial fiber distance.

25. The press jacket in accordance with claim 25, wherein the axial groove distance and the axial fiber distance do not exhibit a common integral multiple.

26. The press jacket in accordance with claim 24, the axial groove distance being greater than the axial fiber distance.

27. The press jacket in accordance with claim 26, the axial groove distance being at least approximately 1.15 times as great as the axial fiber distance.

28. The press jacket in accordance with claim 20, the grooves being formed in a ring-shaped manner around a periphery of the press jacket.

29. The press jacket in accordance with claim 20, the grooves be ing formed by a helical line running around a longitudinal axis of the press jacket.

30. The press jacket in accordance with claim 20, the at least one reinforcing fiber being closed in a ring shape.

31. The press jacket in accordance with claim 20, the at least one reinforcing fiber is formed by a helical line around a longitudinal axis of the press jacket.

32. The press jacket in accordance with claim 31, the at least one reinforcing fiber being composed of a single helical reinforcing fiber.

33. The press jacket in accordance with claim 31, the at least one reinforcing fiber being composed of a plurality of helical reinforcing fibers.

34. The press jacket in accordance with claim 33, the plurality of reinforcing fibers forming a multiple helical line.

35. The press jacket in accordance with claim 20, the at least one reinforcing fiber comprising a plurality of reinforcing fibers located in radially superposed layers.

36. The press jacket in accordance with claim 35, the plurality of reinforcing fibers being arranged so that the reinforcing fibers in different layers are not radially superposed in the same direction in the press jacket.

37. The press jacket in accordance with claim 20, further comprising substantially axially extending reinforcing fibers located within the press jacket.

38. The press jacket in accordance with claim 37, the substantially axially extending reinforcing fibers being located radially inside of the reinforcing fibers running in the peripheral direction.

39. The press jacket in accordance with claim 37, the substantially axially extending reinforcing fibers being located radially outside of the reinforcing fibers running in the peripheral direction.

* * * * *